US007605577B2

(12) United States Patent
Chung

(10) Patent No.: US 7,605,577 B2
(45) Date of Patent: Oct. 20, 2009

(54) START-UP CIRCUIT FOR A BANDGAP CIRCUIT

(75) Inventor: Shine Chung, Taipei Hsien (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 400 days.

(21) Appl. No.: 11/605,501

(22) Filed: Nov. 29, 2006

(65) Prior Publication Data

US 2008/0122526 A1 May 29, 2008

(51) Int. Cl.
*G05F 3/16* (2006.01)
*G05F 1/10* (2006.01)

(52) U.S. Cl. ..... 323/313; 327/539

(58) Field of Classification Search ..... 323/312–317, 323/901, 907; 327/538, 539, 543
See application file for complete search history.

(56) References Cited

U.S. PATENT DOCUMENTS 4,857,823 A * 8/1989 Bitting ..... 323/314
6,191,644 B1 * 2/2001 Srinath et al. ..... 327/539
6,894,473 B1 * 5/2005 Le et al. ..... 323/314
6,972,550 B2 * 12/2005 Hong ..... 323/315
7,286,002 B1 * 10/2007 Jackson ..... 327/539
7,321,256 B1 * 1/2008 Vasudevan ..... 327/539

* cited by examiner

*Primary Examiner*—Matthew V Nguyen
(74) *Attorney, Agent, or Firm*—K & L Gates LLP

(57) ABSTRACT

A startup circuit operating with a bandgap circuit having a predetermined node with a current change proportional to temperature change and a current source connected to the predetermined node comprising: a controllable current switch connected between the predetermined node and a control node of the current source; wherein when the voltage at the predetermined node is floating when starting the bandgap circuit, the controllable current switch biases the current source at the control node whereby the voltage at the predetermined node changes based on the current provided by the current source causing the bandgap circuit to start its normal operation.

15 Claims, 4 Drawing Sheets

START-UP CIRCUIT FOR A BANDGAP CIRCUIT

BACKGROUND

The present invention is related to a device and method for starting a low supply bandgap reference circuit.

The objective of a bandgap reference circuit is to provide a voltage that remains constant when the temperature changes. The bandgap reference circuit generates a stable voltage over a temperature range by utilizing two semiconductor circuits, one for providing a voltage that is proportional to absolute temperature (PTAT) and a second for providing a voltage that is complementary to absolute temperature (CTAT). Conventionally the sum of the two circuits is used to provide a temperature-stabilized voltage reference.

FIG. 1 shows a simplified circuit of a conventional bandgap reference circuit 100. Node A provides a voltage, which is complementary to absolute temperature (CTAT) based on the negative temperature dependent junction voltage of a PN diode, which is about −1.5 mV/° C. Node B provides a large area PN-type device 104 in series with resistor 102 to ground. The feedback loop comprising an opamp 106 and a pair of matched controlled current sources P1 and P2 forces the voltages at node A and node B to be equal. According to the I-V equation of a PN diode, the voltages at nodes A and B, Va and Vb are:

$$Ia=Aa*I0*\exp(qVa/kT)$$

$$Ib=N*Aa*I0*\exp(q(Vb-Ib*Rb)/kT)$$

If Va is set to be equal to Vb, and Ia=Ib, the above two equations can be simplified as $$Ib*Rb=kT/q*\ln(N),$$

so that the current Ib flowing through node B is proportional to absolute temperature.

The output voltage Vbg developed across a resistor in the output stage 110, is a PTAT current Ic, mirrored from Ib, on Rc in series with a negative-temperature-coefficient diode voltage. The Vbg could be designed to be temperature independent if the magnitudes of Ic and Rc are proper to compensate the negative temperature coefficient of a diode.

To reduce power consumption, the feedback loop is generally self-biased. Like other self-biasing circuits, the bandgap reference circuit 100 may have two stable states. The first stable state is when it begins normal operation as designed, and the second stable state is when all the currents are zero (or floating). The circuit can be at zero current when the bandgap circuit initially powers up or as a result of power interruptions. When this zero current state occurs, the bandgap circuit is in a non-started state and the bandgap voltage (Vbg) is improper. A "startup" circuit may be employed to ensure the bandgap reference circuit starts. The purpose of a startup circuit is to ensure the proper operational state can be set during power up without interfering with normal operation of the bandgap circuit once it is started.

FIG. 2 shows a simplified schematic of a conventional bandgap reference circuit 200 with a startup circuit. The bandgap reference circuit 200 is comprised of a diode 108 for providing a CTAT voltage at the node A, a plurality of diodes 104 in series with resistor 102 for providing a PTAT voltage at the node B, and an opamp 106 for controlling two PMOS devices P1 and P2 and providing proper biasing to the PMOS device P3 in the output stage. In the figure the opamp is shown as discrete devices, however, other opamp circuitry may be used. The PMOS devices P1 and P2 provide currents to the nodes A and B. The startup circuit comprises an NMOS device N1 coupled between a complementary power supply such as a ground or VSS, and the gates of the PMOS devices P1 and P2. The NMOS device N1 is controlled by power on a reset signal PONRST generated externally to the circuit.

To operate the power on reset of the bandgap reference circuit 200, the signal PONRST is controlled to a logical "high" such that the NMOS device N1 is turned on. Turning on the NMOS device N1 biases the PMOS devices P1 and P2 into conduction such that they provide a current to the nodes A and B. Once the current passes through either the node A or the node B, the voltages at the nodes A and B are established and the bandgap circuit is brought out of the non-started state and begins normal operation. The drawback to the power on a reset circuit is that is depends on an external signal PONRST to start the bandgap reference circuit.

The deficiencies of the conventional circuitry and methods for starting a bandgap circuit show that a need still exists for improvement. To overcome the shortcomings of the conventional circuitry, new circuitry and method for starting a bandgap circuit is needed.

SUMMARY

This invention is for a startup circuit operating with a bandgap circuit having a predetermined node with a current change proportional to temperature change and a current source connected to the predetermined node comprising: a controllable current switch connected between the predetermined node and a control node of the current source; wherein when the voltage at the predetermined node is floating when starting the bandgap circuit, the controllable current switch biases the current source at the control node whereby the voltage at the predetermined node changes based on the current provided by the current source causing the bandgap circuit to start its normal operation.

The construction and method of operation of the invention, however, together with additional objectives and advantages thereof will be best understood from the following description of specific embodiments when read in connection with the accompanying drawings.

DESCRIPTION

Figure 1:
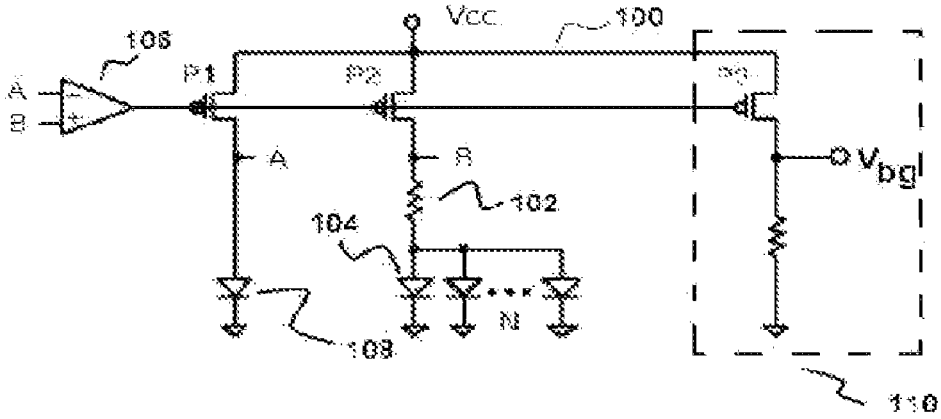
Figure 1 (Prior Art)
FIG. 1 illustrates a conventional bandgap circuit.
Figure 2:
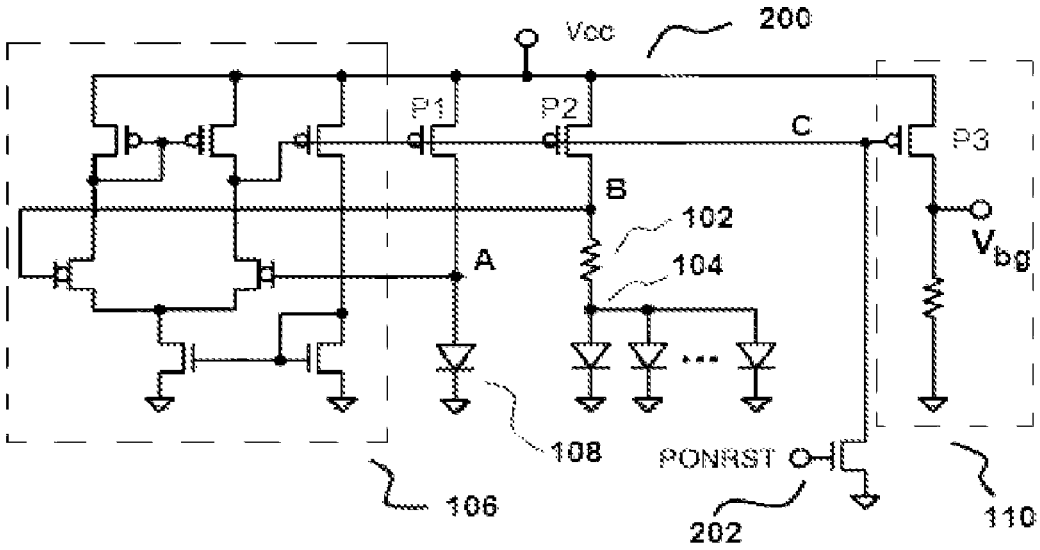
Figure 2 (Prior Art)
FIG. 2 illustrates a circuit schematic for a conventional bandgap circuit and startup circuitry.

This invention relates generally to bandgap reference circuits and more specifically to a system and method of starting a bandgap reference circuit reliably and without interfering with normal circuit operation. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

References in the specification to "one embodiment", "an embodiment", "an example embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one of ordinary skill in the art to affect such feature, structure or characteristic in connection with other embodiments whether or not explicitly described. Parts of the description are presented using terminology commonly employed by those of ordinary skill in the art to convey the substance of their work to others of ordinary skill in the art.

Figure 3:
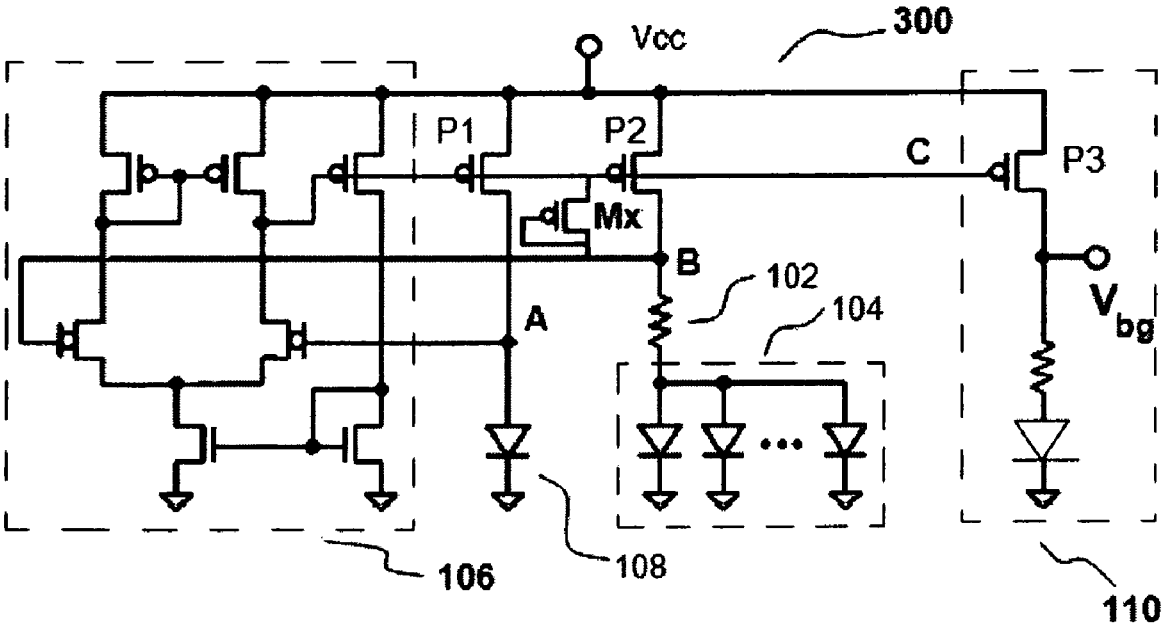
FIG. 3 illustrates one embodiment of the current invention.

FIG. 3 shows one embodiment of the present invention 300. The bandgap reference circuit 300 is comprised of a node A for providing a CTAT voltage (Va) based on a negative temperature dependent junction voltage of a PN diode 108. And a node B for providing a PTAT current (Ib) based on a plurality of semiconductor junctions 104 in series with a resistor 102, an opamp 106 for controlling the PMOS device P1 and the PMOS device P2 and providing proper biasing to the PMOS device P3 in the output stage. The PMOS devices P1 and P2 provide a current to the nodes A and B and the PMOS device P3 provides a current to a resistor in the output stage for generating an output voltage Vbg. This embodiment has a PMOS device Mx coupled between the node B and a node C. The node C is the gate of the PMOS devices P1, P2 and P3. The PMOS device Mx is configured with the gate and drain connected to node B and the source connected to node C.

In view of the foregoing, when the Vb and Va are floating, such as when the bandgap reference 300 does not start, the PMOS device Mx controls the controlled current sources P1 and P2 to supply a current through the nodes A and B. Once the current passes through either node A or B, the voltages Va and Vb are established and the bandgap circuit is brought out of the non-started state and begins normal operation.

It will be appreciated by those having skill in the art that in this embodiment Mx should be designed so that the current flowing through Mx is much smaller than through P2. In a bandgap reference circuit operating with a supply voltage of about 1 volt, Vb should be set to a voltage very close to the voltage at node C (Vc) such that P2 is operating in the saturation region. To ensure proper operation, the initial voltage Vb should be less than $Vc-|V_{th}|$ but the final voltage greater than $Vc-|V_{th}|$ where $V_{th}$ is the threshold voltage of Mx.

It is understood that one skilled in the art of integrated circuit design could affect different means to create a bandgap reference than the one shown. It will also be appreciated by those having ordinary skill in the art that this invention can be practiced using other devices or PN junction modules including but not limited to diodes, cascaded PMOS devices connected as diodes or other PN junction module configurations.

One aspect of the present invention is that it provides circuitry and a method for starting a bandgap circuit during initial power-up or following a power interruption. Some of the advantages of the present invention are simplicity, reliability and, that it does not affect normal bandgap circuit operation once started and would only require a small area if implemented monolithically.

Figure 4:
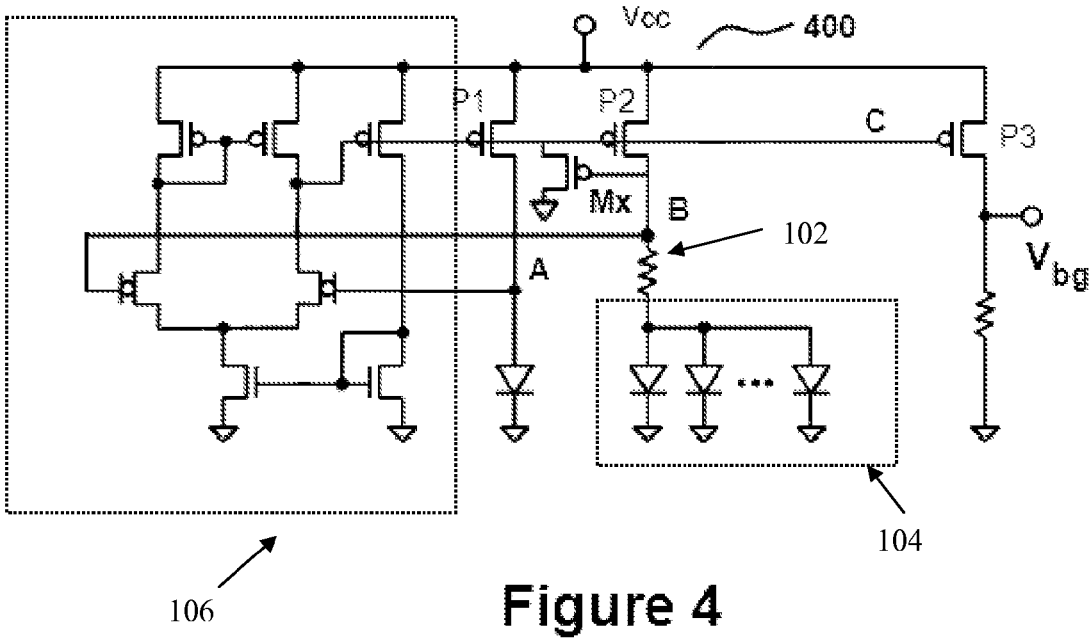
FIG. 4 illustrates another embodiment of the current invention.

FIG. 4 shows another embodiment of this invention 400. The bandgap reference circuit 400 is comprised of a node A for providing a CTAT voltage (Va) based on a negative temperature dependent junction voltage of a PN diode 108. And a node B for providing a PTAT current (Ib) based on a plurality of semiconductor junctions 104 in series with a resistor 102, an opamp 106 for controlling the PMOS device P1 and the PMOS device P2 and providing proper biasing to the PMOS device P3 in the output stage. The PMOS devices P1 and P2 provide a current to the nodes A and B and the PMOS device P3 provides a current to a resistor in the output stage for generating an output voltage Vbg. In this embodiment, a PMOS device Mx is connected having source at node C, the gate at node B and the drain connected to a complementary supply such as ground or VSS.

In view of the foregoing, if the bandgap circuit fails to start, Vb could be floating causing Mx to control the controlled current sources P1 and P2 to supply current through the nodes A and B. Once current passes through either node A or B, the voltages at the nodes A and B are established and the bandgap circuit is brought out of the non-started state and begins normal operation.

It is understood by those having ordinary skill in the art that in this embodiment Vb should be set to a voltage very close to the voltage at node C (Vc) such that P2 is operating in the saturation region. During normal operation Vb should meet the condition $Vb+|Vtp|>Vc$ to cutoff Mx where Vtp is the threshold voltage of Mx.

Figure 5:
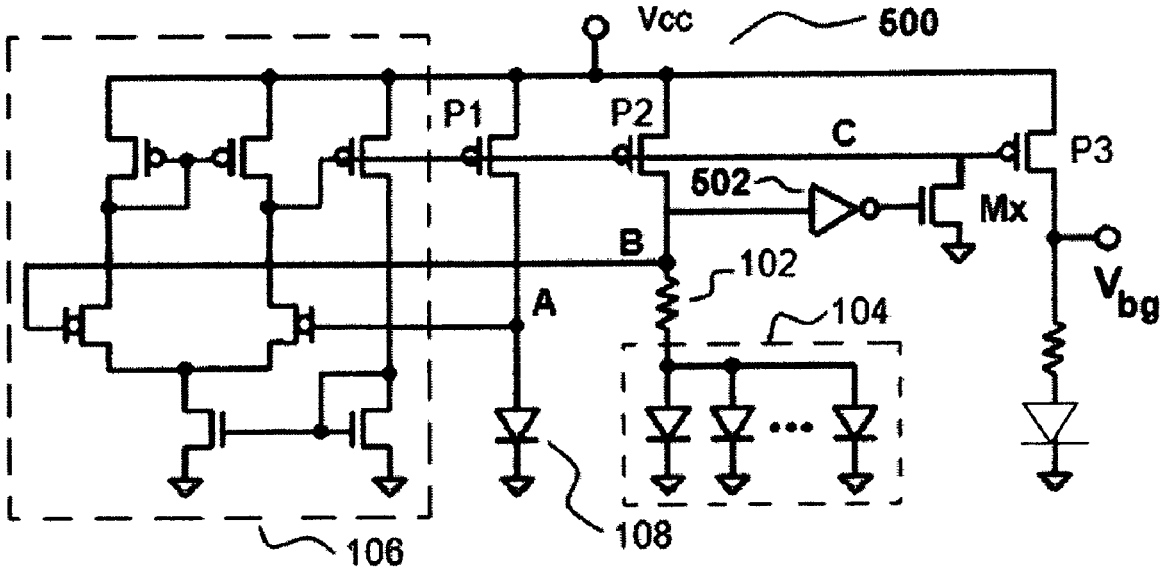
FIG. 5 illustrates yet another embodiment of the current invention.

FIG. 5 shows another embodiment of the current invention 500. The bandgap reference circuit 500 is comprised of a node A for providing a CTAT voltage (Va) based on a negative temperature dependent junction voltage of a PN diode 108. And a node B for providing a PTAT current (Ib) based on a plurality of semiconductor junctions 104 in series with a resistor 102, an opamp 106 for controlling the PMOS device P1 and the PMOS device P2 and providing proper biasing to the PMOS device P3 in the output stage. The PMOS devices P1 and P2 provide a current to nodes A and B and the PMOS device P3 provides a current to a resistor in the output stage for generating an output voltage Vbg. In this embodiment an NMOS device Mx is connected with the source at node C, the drain is connected to a complementary power supply such as ground or VSS and the gate is coupled to node B through an inverter 502.

In this embodiment, if the bandgap circuit does not start, Vb could be floating near Vss. This could be seen as a logical zero on the input of inverter 502 causing a logical 1 at the output of the inverter 502. The logical 1 output of the inverter 502 drives the NMOS device Mx into conduction, thereby lowering the voltage at the gates of the controlled current sources P1 and P2. The devices P1 and P2 will then supply current through nodes A and B. Once current passes through either node A or B, the voltages at nodes A and B are established and the bandgap circuit is brought out of the non-started state and begins normal operation. Once in normal operation, Vb will be seen as a logical 1 at the input of inverter 502 causing a logical 0 at the output of inverter 502 thus shutting off NMOS device Mx.

These embodiments show one of the advantages of the current invention. Once the bandgap circuit is operating properly, device Mx does not affect the normal operation of the bandgap reference. Other advantages include its simplicity, that it does not draw any current from the output stage of the bandgap circuit and that it only operates if the bandgap circuit fails to start properly.

The above illustration provides many different embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A bandgap circuit having a startup circuit, the bandgap circuit comprising:

a first PMOS device coupled between a supply voltage and a first diode for providing a first node with a first voltage that is complementary to absolute temperature (CTAT);

a second PMOS device coupled between the supply voltage and a first resistor for providing a second node with a second voltage that is proportional to absolute temperature (PTAT), wherein the first resistor is connected to a set of diodes further coupled to a complementary supply voltage;

a third PMOS device coupled between the power supply voltage and a second resistor for generating an output voltage, wherein gates of the first, second, and third PMOS devices are connected to a control node; and a controllable current switch connected between the second node and the control node, the controllable current switch being a MOS device whose gate and drain are connected to the second node and whose source is connected to the control node, wherein when the voltage at the second node is floating when starting the bandgap circuit, the controllable current switch biases the control node whereby the second voltage at the second node changes based on a current flowing through the second PMOS device causing the bandgap circuit to start its normal operation.

2. The bandgap circuit of claim 1, wherein the MOS device is a PMOS transistor.

3. The bandgap circuit of claim 1, wherein the set of diodes comprise a plurality of PN junction diodes connected in parallel.

4. The bandgap circuit of claim 1, wherein the a current flowing through the controllable current switch is smaller than that flowing through the second PMOS device.

5. A bandgap circuit having a startup circuit, the bandgap circuit comprising:

a first PMOS device coupled between a supply voltage and a first diode for providing a first node with a first voltage that is complementary to absolute temperature (CTAT);

a second PMOS device coupled between the supply voltage and a first resistor for providing a second node with a second voltage that is proportional to absolute temperature (PTAT), wherein the first resistor is connected to a set of diodes further coupled to a complementary supply voltage;

a third PMOS device coupled between the power supply voltage and a second resistor for generating an output voltage, wherein gates of the first, second, and third PMOS devices are connected to a control node; and a controllable current switch connected between the second node and the control node, the controllable current switch being an NMOS device whose source is connected to the control node, whose drain is connected to the complementary supply and whose gate is connected to the second node having a second voltage that is proportional to absolute temperature (PTAT) via an inverter.

wherein when the voltage at the second node is floating when starting the bandgap circuit, the controllable current switch biases the control node whereby the second voltage at the second node changes based on a current flowing through the second PMOS device causing the bandgap circuit to start its normal operation.

6. The bandgap circuit of claim 5, wherein the set of diodes comprise a plurality of PN junction diodes connected in parallel.

7. The bandgap circuit of claim 5, wherein the a current flowing through the controllable current switch is smaller than that flowing through the second PMOS device.

8. A bandgap circuit having a startup circuit, the bandgap circuit comprising:

a first PMOS device coupled between a supply voltage and a first diode for providing a first node with a first voltage that is complementary to absolute temperature (CTAT);

a second PMOS device coupled between the supply voltage and a first resistor for providing a second node with a second voltage that is proportional to absolute temperature (PTAT), wherein the first resistor is connected to a set of diodes further coupled to a complementary supply voltage;

a third PMOS device coupled between the power supply voltage and a second resistor for generating an output voltage, wherein gates of the first, second, and third PMOS devices are connected to a control node; and a controllable current switch connected between the second node and the control node, the controllable current switch being a MOS device whose gate is connected to the second node having a second voltage that is proportional to absolute temperature (PTAT), whose drain is connected to the complementary supply voltage and whose source is connected to the control node, wherein when the voltage at the second node is floating when starting the bandgap circuit, the controllable current switch biases the control node whereby the second voltage at the second node changes based on a current flowing through the second PMOS device causing the bandgap circuit to start its normal operation.

9. The bandgap circuit of claim 8, wherein the MOS device is a PMOS transistor.

10. The bandgap circuit of claim 8, wherein the set of diodes comprise a plurality of PN junction diodes connected in parallel.

11. The bandgap circuit of claim 8, wherein the a current flowing through the controllable current switch is smaller than that flowing through the second PMOS device.

12. A method for starting a bandgap circuit comprising:

powering up the bandgap circuit;

providing a first PMOS device coupled between a supply voltage and a first diode for generating a first voltage at a first node that is complementary to absolute temperature (CTAT);

providing a second PMOS device coupled between the supply voltage and a first resistor for generating a second voltage at a second node that is proportional to absolute temperature (PTAT), wherein the first resistor is connected to a set of diodes further coupled to a complementary supply voltage;

providing a third PMOS device coupled between the power supply voltage and a second resistor for generating an output voltage, wherein gates of the first, second, and third PMOS devices are connected to a control node; and biasing a MOS device coupled between the second node and the control node when the second voltage at the second node is floating when starting the bandgap circuit, the MOS device biases the second PMOS device whereby the second voltage at the second node changes based on a current provided by the second PMOS device and causing the bandgap circuit to start normal operation.

13. The method for starting a bandgap circuit of claim 12, wherein the MOS device is a PMOS transistor having a source connected to the control node, and a drain and a gate connected to the second node having a second voltage that is proportional to absolute temperature (PTAT).

14. The method for starting a bandgap circuit of claim 12, wherein the first MOS device is a PMOS transistor having a drain connected to the complementary supply, a gate connected to the second node having a second voltage that is proportional to absolute temperature (PTAT), and a source connected to the control node of the second MOS device.

15. The method for starting a bandgap circuit of claim 12, wherein the MOS device is an NMOS device controlled by an output of an inverter, the inverter having an input connected to the second node having a second voltage that is proportional to absolute temperature (PTAT) and the NMOS device having a source connected to the complementary supply and a drain connected to the control node of the second PMOS device.

* * * * *